US010238226B2

(12) United States Patent
Reid et al.

(10) Patent No.: US 10,238,226 B2
(45) Date of Patent: Mar. 26, 2019

(54) TOOTHBRUSH HOLDER

(71) Applicants: Dalila Reid, Canoga Park, CA (US); Tiffany Reid, Canoga Park, CA (US)

(72) Inventors: Dalila Reid, Canoga Park, CA (US); Tiffany Reid, Canoga Park, CA (US)

( * ) Notice: Subject to any disclaimer, the term of this patent is extended or adjusted under 35 U.S.C. 154(b) by 0 days.

(21) Appl. No.: 15/784,085

(22) Filed: Oct. 14, 2017

(65) Prior Publication Data

US 2018/0103786 A1 Apr. 19, 2018

Related U.S. Application Data

(60) Provisional application No. 62/408,675, filed on Oct. 14, 2016.

(51) Int. Cl.
*A47G 29/08* (2006.01)
*A47K 1/09* (2006.01)
*A46B 17/00* (2006.01)

(52) U.S. Cl.
CPC ..... *A47G 29/08* (2013.01); *A46B 17/00* (2013.01); *A47K 1/09* (2013.01)

(58) Field of Classification Search
CPC ..... A47G 29/08; A47K 1/09; A46B 15/0095; A46B 17/04; A46B 17/00; A45D 44/18
USPC ... 211/65, 60.1, 163, 205, 196, 66, 69, 69.1, 211/69.2, 69.4, 119.009; 206/361, 362, 206/362.1, 362.2, 15.2, 209, 209.1; 248/110
See application file for complete search history.

(56) References Cited

U.S. PATENT DOCUMENTS 652,257 A * 6/1900 Folger ..... B41K 1/58 101/407.1
4,688,685 A * 8/1987 Brace ..... A63C 11/028 211/60.1
5,769,245 A * 6/1998 Butler ..... A47K 1/09 211/65
5,772,050 A * 6/1998 Shih ..... B41K 1/58 211/163
6,186,324 B1 * 2/2001 Catterson ..... A45D 44/18 206/15.2
6,935,515 B1 * 8/2005 Sookoo ..... A46B 15/0091 211/65
2003/0106868 A1 * 6/2003 Cramer ..... A47G 25/06 211/106.01
2006/0011209 A1 * 1/2006 Mehes ..... A46B 17/00 132/310
2006/0243685 A1 * 11/2006 Monroig ..... A47K 1/09 211/65

(Continued)

*Primary Examiner* — Hiwot E Tefera
(74) *Attorney, Agent, or Firm* — RG Patent Consulting, LLC; Rachel Gilboy

(57) ABSTRACT

An improved toothbrush holder comprising: a base portion; a post member; a first platform; and a second platform. The improved toothbrush holder is adapted to allow a plurality of toothbrushes to be placed respectively through each of said plurality of toothbrush holding apertures and contact respective toothbrush holding indentations at handle ends thereof, such that after use and wet, the toothbrushes can drip dry; and wherein water dripping from each of the plurality of toothbrushes can pass through each of said at least one drain hole of each respective said toothbrush holding indentation and fall upon said base portion, to thereby allow each of said plurality of toothbrushes to drip and air dry for further use.

11 Claims, 4 Drawing Sheets

(56) References Cited

U.S. PATENT DOCUMENTS

| | | | | |
|---|---|---|---|---|
| 2009/0014399 | A1* | 1/2009 | Bott | A47K 1/09 211/85.12 |
| 2010/0326932 | A9* | 12/2010 | Morris | A47K 1/09 211/65 |
| 2011/0198454 | A1* | 8/2011 | Volk | A47K 1/09 248/111 |
| 2012/0318761 | A1* | 12/2012 | Volk | A47K 1/09 211/65 |
| 2014/0252925 | A1* | 9/2014 | Tooma | A46B 17/00 312/207 |
| 2014/0263877 | A1* | 9/2014 | Vidaver | A47K 1/09 248/110 |
| 2014/0346067 | A1* | 11/2014 | Martin | A47K 1/09 206/362.1 |
| 2015/0150420 | A1* | 6/2015 | Volk | A47K 1/09 15/167.1 |

* cited by examiner

TOOTHBRUSH HOLDER

CROSS-REFERENCE TO RELATED APPLICATION

The present application is related to and claims priority from prior provisional application Ser. No. 62/408,675, filed Oct. 14, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of holding devices and more specifically relates to an improved toothbrush holder structured and arranged to suspend and protect four toothbrushes, each of which will be kept dry and hygienic comprising a hinged cap to cover and shield the toothbrush heads, and an open-air, handle stand with drainage holes beneath each brush handle to allow excess water to drain away from the toothbrush completely, keeping the entire toothbrush clean and dry, and out of sitting water, germs and bacteria.

2. Description of the Related Art

The toothbrush is an oral hygiene instrument used to clean the teeth, gums, and tongue. It consists of a head of tightly clustered bristles mounted on a handle which facilitates the cleaning of hard to reach areas of the mouth. Toothbrushes are available with different bristle textures, sizes, and forms. Most dentists recommend using a soft toothbrush since hard bristled toothbrushes can damage tooth enamel and irritate the gums.

Brushing one's teeth is one of the most important parts of healthy personal hygiene. In addition to freshening the breath and strengthening the teeth, proper brushing also kills the germs and bacteria that can grow inside the mouth. Recently, the Office of the Surgeon General released its first ever report on the oral health of America and the results were surprising. According to the report, the most common chronic childhood disease by far in this country is tooth decay. In fact, American children lose a staggering 512 million school hours a year due to dental related illness.

Adults also suffer from various forms of dental disease and these complications can lead to painful oral surgeries and costly trips to the dentist. A booming industry, the national health expenditures for dental services exceed 60 billion dollars per year. While the Office of the Surgeon General reports that there have been vast improvements in the past 50 years regarding oral health issues, much can still be done in this area. Health professionals maintain that through education and a concerted effort, the number of adults and children suffering from dental disease can be significantly reduced. To have a healthy smile, the American Dental Association recommends that we should brush our teeth at least twice daily.

We all know that we should brush and floss daily—but what if our toothbrush, which we think of as ridding our mouths of bacteria, is actually contributing to the problem rather than solving it? Unfortunately, this is most often the case. Most of us, once we're done brushing, leave our toothbrushes to dry in a mug or glass by the bathroom sink—and because that mug or glass has a solid bottom, water draining from the toothbrush(es) collects here, stagnates, and offers bacteria a prime pasture for growth; a bacterial pasture that is transferred to our hand when we again pick up our toothbrush to brush our teeth! Further, when the bristles of the toothbrush are left exposed to air in the bathroom, they can collect airborne bacteria—even *E. coli* bacteria dispersed as aerosol particulates from flushing toilets—and thus defeat our earnest efforts to maintain good dental hygiene.

Various attempts have been made to solve problems found in holding devices art. Among these are found in: U.S. Publication No. 2014/0346067 to Cindy D. Martin; U.S. Pat. No. D502623 to Curt Minard et al.; and U.S. Publication No. 2010/0051565 to Jose C. Fonseca. This prior art is representative of holding devices for toothbrushes.

Ideally, an improved toothbrush holder should be user-friendly and safe in-use and, yet should operate reliably and be manufactured at a modest expense. Thus, a need exists for an improved toothbrush holder structured and arranged to suspend and protect four toothbrushes, each of which will be kept dry and hygienic comprising a hinged cap to cover and shield the toothbrush heads, and an open-air, handle stand with drainage holes beneath each brush handle to allow excess water to drain away from the toothbrush completely, keeping the entire toothbrush clean and dry, and out of sitting water, germs and bacteria.

BRIEF SUMMARY OF THE INVENTION

In view of the foregoing disadvantages inherent in the known holding device art, the present invention provides an improved toothbrush holder. The general purpose of the present invention, which will be described subsequently in greater detail is to provide an improved toothbrush holder structured and arranged to suspend and protect four toothbrushes, each of which will be kept dry and hygienic comprising a hinged cap to cover and shield the toothbrush heads, and an open-air, handle stand with drainage holes beneath each brush handle to allow excess water to drain away from the toothbrush completely, keeping the entire toothbrush clean and dry, and out of sitting water, germs and bacteria An improved toothbrush holder comprising: a base portion; a post member; a first platform; and a second platform. The base portion is adapted to be stably placed upon a supporting surface. The post member is releasably attached to the base portion at a proximal end thereof and extends perpendicularly upwards therefrom. The first platform includes a plurality of toothbrush holding indentations upon an upper surface thereof. Each of the plurality of toothbrush holding indentations includes at least one drain hole therethrough. The first platform is attached to the post member at a mid-section thereof. The second platform includes a plurality of toothbrush holding apertures extending therethrough each adapted to allow a toothbrush to pass therethrough. The second platform is attached to a distal end of the post member.

The improved toothbrush holder is adapted to allow a plurality of toothbrushes to be placed respectively through each of the plurality of toothbrush holding apertures and contact respective toothbrush holding indentations at handle ends thereof, such that after use and wet, the toothbrushes can drip dry; and wherein water dripping from each of the plurality of toothbrushes can pass through each of the at least one drain hole of each respective the toothbrush holding indentation and fall upon the base portion, to thereby allow each of the plurality of toothbrushes to drip and air dry for further use.

The present invention holds significant improvements and serves as an Improved Toothbrush Holder. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, an Improved Toothbrush Holder, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a holding device and more specifically relates to an improved toothbrush holder structured and arranged to suspend and protect four toothbrushes, each of which will be kept dry and hygienic comprising a hinged cap to cover and shield the toothbrush heads, and an open-air, handle stand with drainage holes beneath each brush handle to allow excess water to drain away from the toothbrush completely, keeping the entire toothbrush clean and dry, and out of sitting water, germs and bacteria Generally speaking, the Improved Toothbrush Holder comprises a specially designed new and improved countertop holder for toothbrushes: a holder that would eliminate the problem of water "ponding" in the bottom of a cup or glass; allow toothbrush bristles to air-dry while being protected from airborne bacterial contamination—and do all of this while presenting a clean, modern, streamlined style that would enhance the décor of any household bathroom.

The Improved Toothbrush Holder might be fabricated in either an injection-molded thermoplastic or a glazed-and-fired ceramic. The Holder features a rounded, or dome-shaped base, ensuring that any water droplets will drain off it onto the counter for easy cleaning. The bottom of the base will be finished with a no-slip rubber coating to ensure stability. From the center of the dome-shaped base rises a cylindrical tube, this tube supporting a pair of oblong platforms—one nearer the bottom, and the other at the top. The top platform would feature four holes situated at the cardinal points (North, South, East and West) so that the handle-end of the toothbrush is inserted through the hole in the top platform, with the bristle-head resting above the hole, and the bottom of the handle resting on the lower platform or handle stand, in its corresponding, concave drainage point.

The Improved Toothbrush Holder would hold four toothbrushes in this manner, each amply separated from the others, and each able to drain off any excess water without any pooling. A formfitting, dome-shaped, hinged cover would snap over and onto the top platform, and protect the head and bristles from airborne bacteria as well. The Improved Toothbrush Holder could be produced in a wide variety of colors to suit the range of consumer tastes in bathroom décor.

Figure 1:
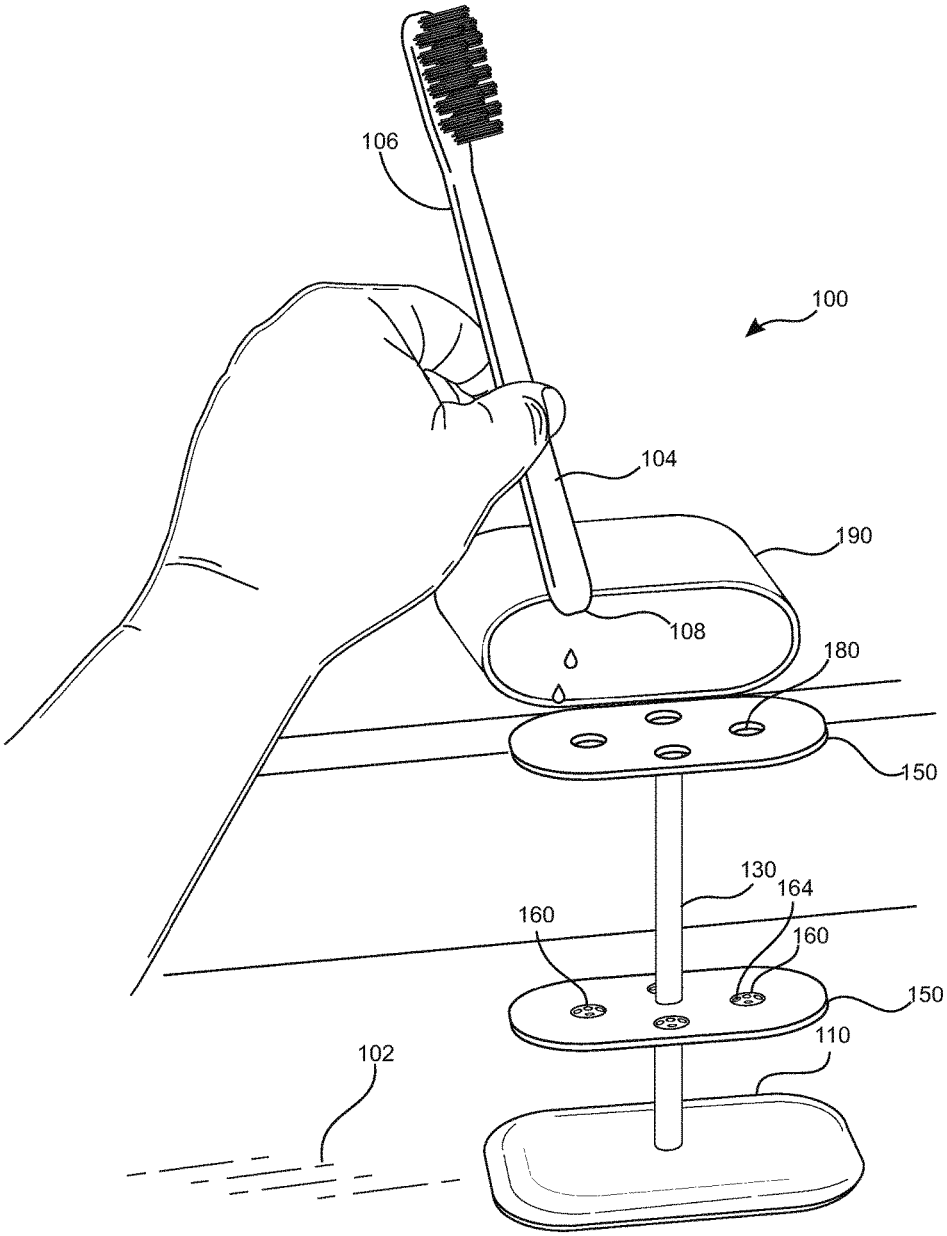
FIG. 1 shows a perspective view illustrating an improved toothbrush holder in an in-use condition according to an embodiment of the present invention.
Figure 2:
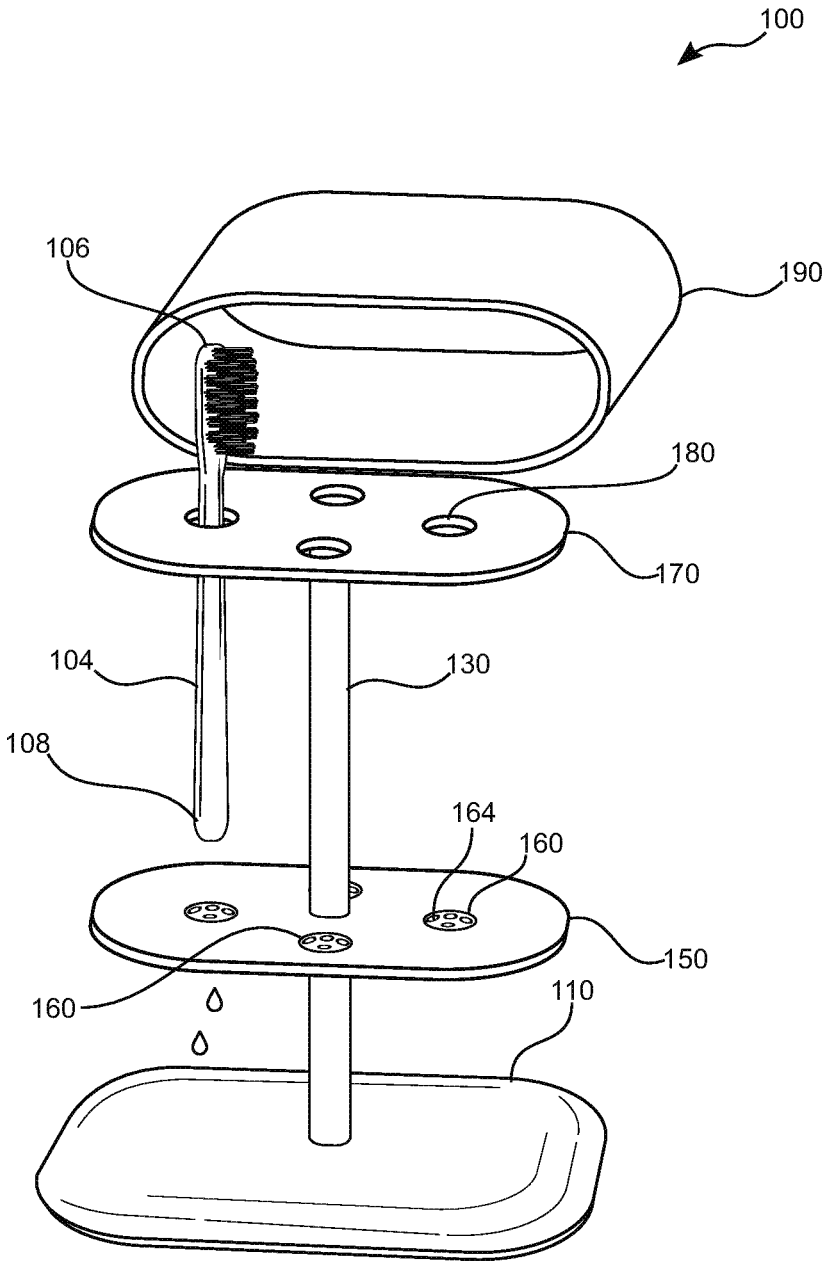
FIG. 2 is a perspective view illustrating the improved toothbrush holder according to an embodiment of the present invention.
Figure 3:
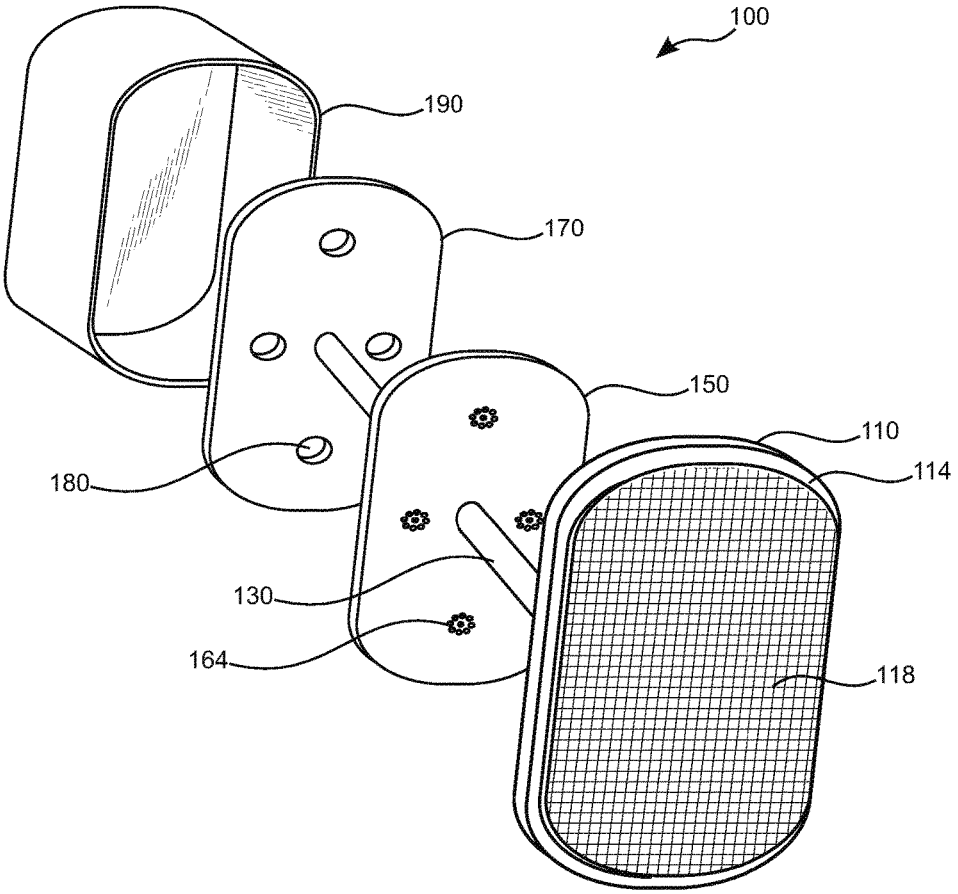
FIG. 3 is a side perspective view illustrating the improved toothbrush holder according to an embodiment of the present invention.
Figure 4:
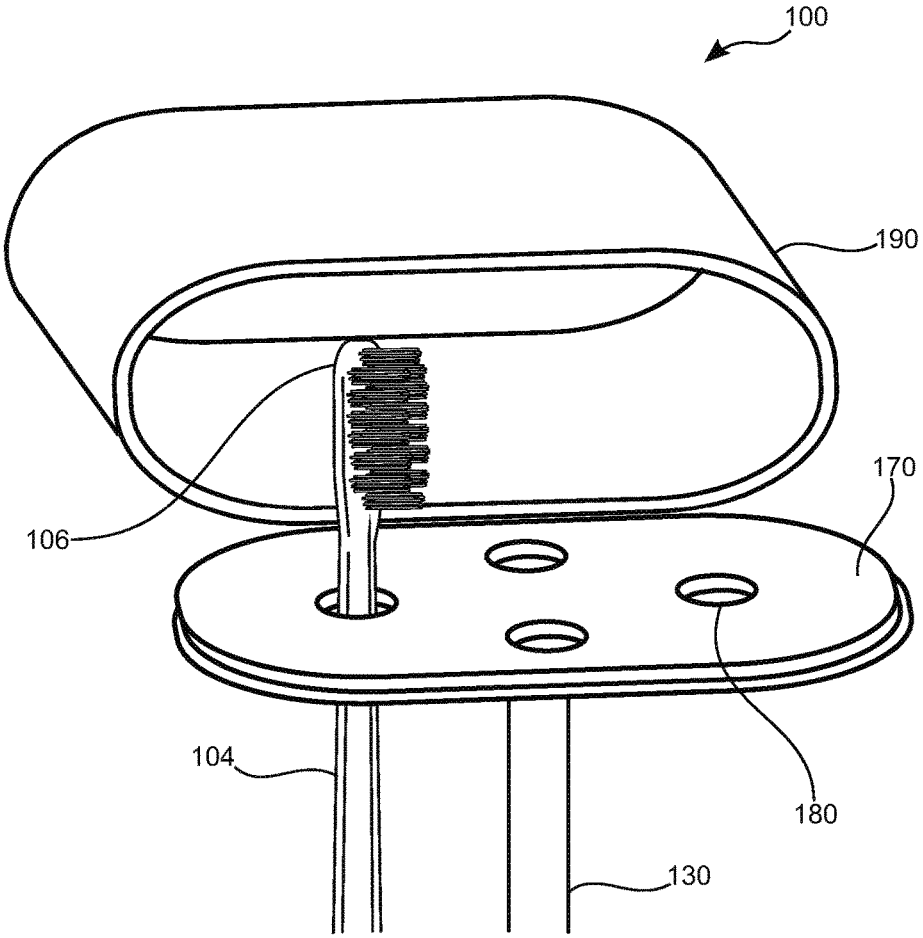
FIG. 4 is a perspective view illustrating the improved toothbrush holder according to an embodiment of the present invention of FIG. 1.

The Improved Toothbrush Holder would protect toothbrush bristles from the bacterial contaminants from in the bathroom air, and furthermore, would eliminate the problem of water accumulation, like that in the bottom of any ordinary toothbrush holder, cup, glass, or mug—water that breeds bacteria, which then attaches to the toothbrush handle, and from there attaches to the user's hand, and so forth. Clever in conception and thoughtful in design, the Improved Toothbrush Holder has been conceived to meet a real need for better toothbrush hygiene shared by millions of consumers Referring now to FIGS. 1-3, showing perspective views illustrating improved toothbrush holder 100 according to an embodiment of the present invention of FIG. 1.

Improved toothbrush holder 100 comprising: base portion 110; post member 130; first platform 150; and second platform 170. Base portion 110 is adapted to be stably placed upon supporting surface 102. Base portion 110 is formed having a dome-shape adapted to force water dripping thereon to drain off therefrom. Base portion 110 includes bottom surface 114 including rubber coating 118 adapted to provide non-slip contact to supporting surface 102.

Post member 130 is releasably attached to base portion 110 at a proximal end thereof and extends perpendicularly upwards therefrom. Post member 110 is formed as an elongated tube.

First platform 150 includes plurality of toothbrush holding indentations 160 upon an upper surface thereof. Each of the plurality of toothbrush holding indentations 160 includes at least one drain hole 164 therethrough. Wherein each of plurality of toothbrush holding indentations 160 includes plurality of drain holes 164 therethrough. First platform 150 is attached to the post member at a mid-section thereof.

Second platform 170 includes plurality of toothbrush holding apertures 180 extending therethrough each adapted to allow toothbrush 104 to pass therethrough. Wherein there are four toothbrush holding indentations 160 and four toothbrush holding apertures 180. Second platform 170 is attached to a distal end of post member 130. Improved toothbrush holder 100 further comprising cover member 190 adapted to releasably attach to second platform 170 and releasably cover brush ends 106 of plurality of toothbrushes 104. First platform 150 and second platform 170 are oblong shaped.

Base portion 110, post member 130, and first platform 150 and second platform 170 may be formed from injection-molded thermoplastic material. Further, base portion 110, post member 130, and first platform 150 and second platform 170 may be formed from glazed and fired ceramic material.

Improved toothbrush holder 100 is adapted to allow plurality of toothbrushes 104 to be placed respectively through each of plurality of toothbrush holding apertures 180 and contact respective toothbrush holding indentations 160 at handle ends 108 thereof, such that after use and wet, toothbrushes 104 can drip dry; and wherein water dripping from each of plurality of toothbrushes 104 can pass through each of at least one drain hole 164 of each respective toothbrush holding indentation 160 and fall upon base portion 110, to thereby allow each of plurality of toothbrushes 104 to drip and air dry for further use.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An improved toothbrush holder comprising:

a base portion;

wherein said base portion is adapted to be stably placed upon a supporting surface;

a post member;

wherein said post member is releasably attached to said base portion at a proximal end thereof and extends perpendicularly upwards therefrom;

a first platform including:

a plurality of toothbrush holding indentations upon an upper surface thereof; wherein each of said plurality of toothbrush holding indentations includes at least one drain hole therethrough;

wherein said first platform is attached to said post member at a mid-section thereof; and a second platform including:

a plurality of toothbrush holding apertures extending therethrough each adapted to allow a toothbrush to pass therethrough;

wherein said second platform is attached to a distal end of said post member;

wherein said improved toothbrush holder is adapted to allow a plurality of toothbrushes to be placed respectively through each of said plurality of toothbrush holding apertures and contact respective toothbrush holding indentations at handle ends thereof, such that after use and wet, said toothbrushes can drip dry; and wherein water dripping from each of said plurality of toothbrushes can pass through each of said at least one drain hole of each respective said toothbrush holding indentation and fall upon said base portion, to thereby allow each of said plurality of toothbrushes to drip and air dry for further use; and wherein said plurality of toothbrush holding apertures of said second platform and said plurality of toothbrush holding indentations of said first platform are in vertical alignment and adapted to hold toothbrushes in a vertical orientation respectively therebetween.

2. The improved toothbrush holder of claim 1, wherein said base portion is formed having a dome-shape adapted to force water dripping thereon to drain off therefrom.

3. The improved toothbrush holder of claim 1, wherein said base portion includes a bottom surface including a rubber coating adapted to provide non-slip contact to said supporting surface.

4. The improved toothbrush holder of claim 1, wherein said post member is formed as an elongated tube.

5. The improved toothbrush holder of claim 1, wherein each of said plurality of toothbrush holding indentations includes a plurality of drain holes therethrough.

6. The improved toothbrush holder of claim 1, further comprising a cover member adapted to releasably attach to said second platform and releasably cover brush ends of said plurality of toothbrushes.

7. The improved toothbrush holder of claim 1, further comprising a cover member pivotally attached to said second platform and adapted to selectively cover brush ends of said plurality of toothbrushes.

8. The improved toothbrush holder of claim 1, wherein said first and second platforms are oblong shaped.

9. The improved toothbrush holder of claim 1, wherein there are four toothbrush holding indentations and four toothbrush holding apertures.

10. The improved toothbrush holder of claim 1, wherein said base portion, said post member, and said first and second platforms are formed from injection-molded thermoplastic material.

11. The improved toothbrush holder of claim 1, wherein said base portion, said post member, and said first and second platforms are formed from glazed and fired ceramic material.

* * * * *